US012338623B2

(12) United States Patent
Pfeifer et al.

(10) Patent No.: US 12,338,623 B2
(45) Date of Patent: Jun. 24, 2025

(54) ATTACHMENT COMPONENTS AND SYSTEM FOR CEILING PANELS

(71) Applicant: 9Wood, Inc., Springfield, OR (US)

(72) Inventors: Nathan Pfeifer, Eugene, OR (US); Rhett Shidaker, Eugene, OR (US)

(73) Assignee: 9Wood, Inc., Springfield, OR (US)

( * ) Notice: Subject to any disclaimer, the term of this patent is extended or adjusted under 35 U.S.C. 154(b) by 359 days.

(21) Appl. No.: 17/713,114

(22) Filed: Apr. 4, 2022

(65) Prior Publication Data

US 2023/0313528 A1 Oct. 5, 2023

(51) Int. Cl.
*E04B 9/22* (2006.01)
*E04B 9/06* (2006.01)

(52) U.S. Cl.
CPC ..... *E04B 9/225* (2013.01); *E04B 9/067* (2013.01)

(58) Field of Classification Search
CPC ..... E04B 9/225; E04B 9/067; E04B 9/0478; E04B 9/26
See application file for complete search history.

(56) References Cited

U.S. PATENT DOCUMENTS

| | | | |
|---|---|---|---|
| 365,295 | A | 6/1887 | Bright |
| 2,250,411 | A | 7/1941 | Baker |
| 2,318,092 | A | 5/1943 | Olsen |
| 2,481,794 | A | 9/1949 | Stitt |
| 3,001,616 | A | 9/1961 | Griffin |
| 3,032,833 | A | 5/1962 | Stanley |
| 3,248,839 | A | 5/1966 | Roberts et al. |

(Continued)

FOREIGN PATENT DOCUMENTS

| | | | |
|---|---|---|---|
| AT | 206159 | B | 11/1959 |
| AT | 213607 | B | 2/1961 |

(Continued)

OTHER PUBLICATIONS

U.S. Patent and Trademark Office, Non Final Office Action regarding U.S. Appl. No. 13/865,145, filed Apr. 8, 2014, 12 pages.

(Continued)

*Primary Examiner* — Rodney Mintz
(74) *Attorney, Agent, or Firm* — Kolisch Hartwell, P.C.

(57) ABSTRACT

An attachment system providing for connecting ceiling panels to a grid of suspended T-bars, may include plural plates attached to the upper surface of the ceiling panel. Each plate may include a standoff that offsets the plate's main surface to provide a space between the plate and the panel where a yoke may be captured but remain movable in a horizontal plane a sufficient amount to improve alignment of the ceiling panels. Each spring yoke may couple a spring to a slot on a spring holster on the grid of suspended bars. Each spring may be provided with first and second positioning mechanisms cooperating with the slot in the spring holster to provide an installed position and an accessible position. The system may include one or more alignment clips and stiffener clips and stiffener bars. The alignment clips may cooperate with the spring yokes' movability relative to the panel for alignment of adjacent panels. The stiffener bars may cooperate with the stiffener clips and the plates to allow horizontal expansion and contraction and prevent vertical warping of the panel.

16 Claims, 9 Drawing Sheets

(56) References Cited

U.S. PATENT DOCUMENTS 3,332,194 A 7/1967 Jack
3,488,908 A 1/1970 Jahn
3,640,042 A 2/1972 Kidney
3,714,753 A 2/1973 Jahn
3,875,717 A 4/1975 Moeller
3,900,997 A 8/1975 Ollinger et al.
3,930,338 A * 1/1976 Rood ..... E04B 9/003 52/506.06
4,189,893 A 2/1980 Kuhr
4,283,891 A 8/1981 Moeller
4,317,418 A 3/1982 Courshon, Jr. et al.
4,438,613 A * 3/1984 Hintsa ..... E04B 9/14 52/800.11
4,463,537 A 8/1984 Rodriquez et al.
4,471,593 A 9/1984 Ragland
4,490,957 A 1/1985 Bumpus et al.
4,696,141 A 9/1987 Nassof
4,722,161 A 2/1988 Young
4,760,677 A 8/1988 Nassof
4,862,663 A 9/1989 Krieger
5,239,801 A 8/1993 Adams
5,417,025 A 5/1995 Nute et al.
5,428,930 A * 7/1995 Bagley ..... E04B 9/003 52/489.1
5,507,125 A 4/1996 McClure
5,623,800 A 4/1997 Shinkosky
6,108,994 A 8/2000 Bodine
6,145,264 A 11/2000 Dallaire
6,230,463 B1 5/2001 Bodine
6,389,771 B1 5/2002 Moller
6,971,210 B2 * 12/2005 Kliegle ..... E04B 9/225 52/489.1
7,076,928 B2 * 7/2006 Kliegle ..... E04B 9/28 52/506.07
8,683,768 B2 * 4/2014 Gerkes ..... E04B 9/0428 52/489.1
9,187,896 B1 * 11/2015 Bergman ..... E04B 9/10
9,194,123 B2 * 11/2015 Holdridge ..... E04B 9/26
9,435,121 B2 * 9/2016 Bergman ..... E04B 9/26
9,605,428 B2 * 3/2017 Fladeland ..... E04B 9/0428
9,745,746 B2 * 8/2017 Heesbeen ..... E04B 9/24
9,879,424 B1 * 1/2018 Underkofler ..... E04B 9/068
10,113,317 B1 * 10/2018 Laydera-Collins ..... E04F 13/0858
2004/0118068 A1 * 6/2004 Kliegle ..... E04B 9/16 52/506.07
2007/0193131 A1 * 8/2007 Ortiz ..... E04B 9/0478 52/144
2008/0086962 A1 4/2008 Jahn et al.
2010/0064618 A1 3/2010 Boyd
2011/0067337 A1 3/2011 Jahn et al.
2011/0078970 A1 4/2011 Boyd
2012/0023853 A1 * 2/2012 Gerkes ..... E04B 9/225 52/506.06
2012/0291397 A1 11/2012 Bergman
2013/0269278 A1 10/2013 Pfeifer et al.
2015/0308112 A1 * 10/2015 Holdridge ..... E04B 9/0478 52/506.08
2015/0345139 A1 * 12/2015 Underkofler ..... E04B 9/26 52/506.08
2016/0145863 A1 * 5/2016 Bergman ..... E04B 9/26 52/698
2016/0208488 A1 * 7/2016 Fladeland ..... E04B 9/225
2016/0251855 A1 * 9/2016 Heesbeen ..... E04B 9/067 52/506.05
2023/0407634 A1 * 12/2023 Watson ..... E04B 9/04

FOREIGN PATENT DOCUMENTS

FR 1227191 A 8/1960
FR 1313963 A 1/1963
GB 2163787 A 3/1986
GB 2200151 A 7/1988
GB 2204073 A 11/1988
GB 2258257 A 3/1993

OTHER PUBLICATIONS

U.S. Patent and Trademark Office, Final Office Action regarding U.S. Appl. No. 13/865,145, filed Jul. 8, 2015, 6 pages.

* cited by examiner

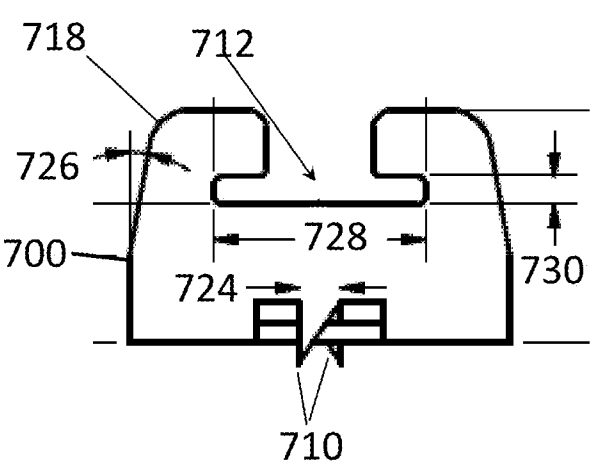
Fig. 23
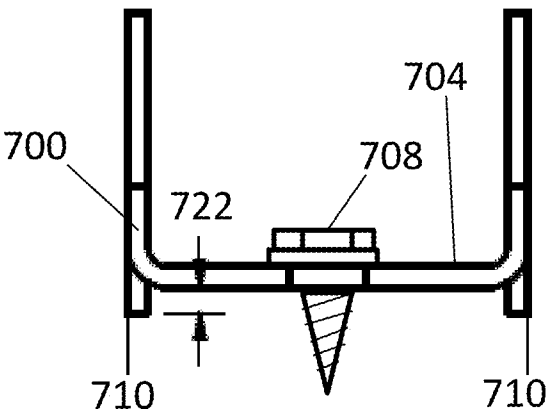
Fig. 24
Fig. 25

ATTACHMENT COMPONENTS AND SYSTEM FOR CEILING PANELS

BACKGROUND

This disclosure relates to components and a system for attachment of ceiling panels (tiles, grilles, panelized linears) to a grid, such as a T-bar grid commonly used in installing a suspended ceiling. More specifically, this disclosure relates to components and a system that provide for suspending such panels in an accessible manner while maintaining straight and uniform lines at the panel edges. Ceiling panels as used herein includes products referred to as tiles, grilles, and panelized linears as well as any other structure with a standardized shape to be removably suspended in a matrix to provide a lowered ceiling.

Ceiling panels for use with a suspended grid typically have clips on an upper side configured to hang the panel from the flange (horizontal surface) of standard T-bar. A safety strap may also attach to the T-bar to provide seismic compliance, i.e., in the case of an earthquake dislodging a panel's clips from the T-bar, the panel will remain attached to the T-bar and fall only to the extent allowed by the safety strap. Panels of these and other previous designs have certain disadvantages that are solved by the present disclosure. For example, the existing system installation and manufacturing tolerances for the T-bar grid and the clips and other suspension hardware make installation and maintenance of the panels with narrow, straight, and uniform spaces between panels difficult and do not provide for reliable and efficient access to the area above the panels. The system and components of the present disclosure provide compensation for variations resulting from installation and manufacturing tolerances so that panels can be installed with clean reveal lines between the panels and with ready access to the space above the panels for maintenance of building infrastructure.

SUMMARY

According to one embodiment of the present disclosure, a system for connecting a ceiling panel to a grid of suspended bars, where each ceiling panel defines a lower surface opposite an upper surface, may provide for a plurality of plates attached to the upper surface of the ceiling panel, each plate defining a main surface and a standoff that is offset from the main surface by an offset distance wherein the plate is configured, when attached to the ceiling panel, for the standoff to be in contact with the upper surface of the ceiling panel and the main surface to be separated from the upper surface of the ceiling panel. The system may further provide for a plurality of spring yokes coupled adjacent the upper surface of the ceiling panel, each spring yoke including a horizontal portion configured to fit beneath the main surface of a corresponding one of the plates for coupling to the ceiling panel, the horizontal portion further including a window that is sized to receive the standoff of the plate to allow the spring yoke to move in a plane parallel to the upper surface of the ceiling panel. The system may further provide for a plurality of springs, each spring configured for coupling a corresponding one of the spring yokes to the grid of suspended bars.

According to another embodiment of the present disclosure, a system for connecting ceiling panels to a grid of suspended bars, where each ceiling panel defines a lower surface opposite an upper surface, may provide for a plurality of spring yokes coupled adjacent the upper surface of the ceiling panel. The system may further provide for a plurality of springs, each spring including a first end coupled to the spring yoke and a second end opposite the first end, each spring configured for coupling to the grid of suspended bars, each spring including a first positioning mechanism and a second positioning mechanism. The system may further provide fora plurality of spring holsters configured to be attached to the suspended bars, each spring holster including a slot for receiving the first and second positioning mechanisms of the spring for coupling the ceiling panel to the grid of suspended bars, wherein the first positioning mechanism allows for the ceiling panel to be coupled to the grid of suspended bars in an installed position and the second positioning mechanism allows for the ceiling panel to be coupled to the grid of suspended bars in an accessible position.

According to still another embodiment of the present disclosure, a system for connecting ceiling panels to a grid of suspended bars, where each ceiling panel defines a lower surface opposite an upper surface, may provide for a plurality of spring yokes coupled adjacent the upper surface of the ceiling panel, each spring yoke coupled with a mechanism allowing the spring yoke to move in a plane parallel to the upper surface of the ceiling panel. The system may further provide for an alignment clip attached to the upper surface of the ceiling panel, the alignment clip including a flat surface configured to rest against one of the suspended bars to align the ceiling panel with the grid through movement of the spring yokes in the plane parallel to the upper surface of the ceiling panel. The system may further provide for a plurality of springs, each spring including a first end coupled to the spring yoke and a second end opposite the first end, each spring configured for coupling to the grid of suspended bars.

According to yet another embodiment of the present disclosure, a system for connecting ceiling panels to a grid of suspended bars, where each ceiling panel defines a lower surface opposite an upper surface, may provide for a plurality of plates attached to the upper surface of the ceiling panel, each plate including a channel for receiving a stiffener bar. The system may further provide for a plurality of spring yokes coupled adjacent the upper surface of the ceiling panel, each spring yoke attached to the ceiling panel by a corresponding one of the plurality of plate. The system may further provide for a plurality of springs, each spring including a first end coupled to the spring yoke and a second end opposite the first end, each spring configured for coupling to the grid of suspended bars.

According to a further embodiment of the present disclosure, a system for connecting ceiling panels to a grid of suspended bars, where each ceiling panel defines a lower surface opposite an upper surface, may provide for a plurality of spring yokes coupled adjacent the upper surface of the ceiling panel, each spring yoke including a bracket. The system may further provide for a plurality of springs, each spring configured to couple to the bracket of the spring yoke, each spring further including a first end configured for coupling to the spring yoke in an installation-ready position and a second end configured for coupling to the spring yoke in a storage position.

BRIEF DESCRIPTION OF THE DRAWINGS

FIG. 23 is an isometric view of the stiffener clip according to the present disclosure, showing the flat, central portion, two side edges, a screw hole, keyed alignment notches, a channel for a stiffener bar (FIG. 15) and a pair of lances.

FIG. 24 is side view of the stiffener clip of FIG. 23, showing the flat, central portion, two side edges, a screw in the hole, and the pair of lances.

FIG. 25 is another side view of the stiffener clip, rotated 90° from FIG. 24, showing one of the side edges, the lances, and the channel for the stiffener bar in an upper angled edge with rounded corners.

DETAILED DESCRIPTION

Figure 1:
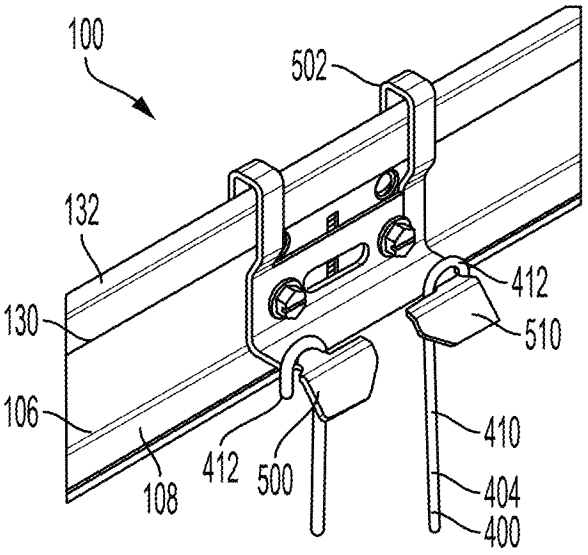
FIG. 1 is an isometric view of a section of a standard T-bar that forms a part of a grid for suspending ceiling panels, and a slotted spring holster and a spring with hooks of the present disclosure, the slotted spring holster disposed over and fastened to the T-bar section and the hooks of the spring hanging in the slots of the spring holster.
Figure 3:
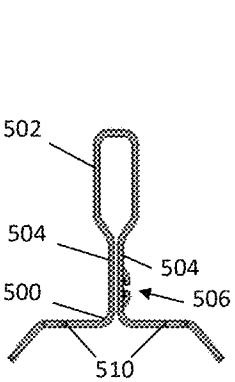
FIG. 3 is a side view of the slotted spring holster of FIG. 1 separate from the T-bar.
Figure 2:
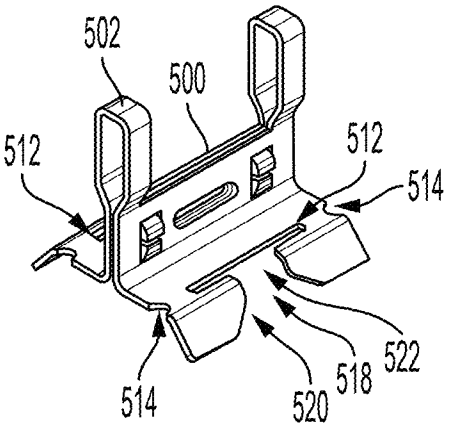
FIG. 2 is an isometric view of the slotted spring holster of FIG. 1 separate from the T-bar.
Figure 4:
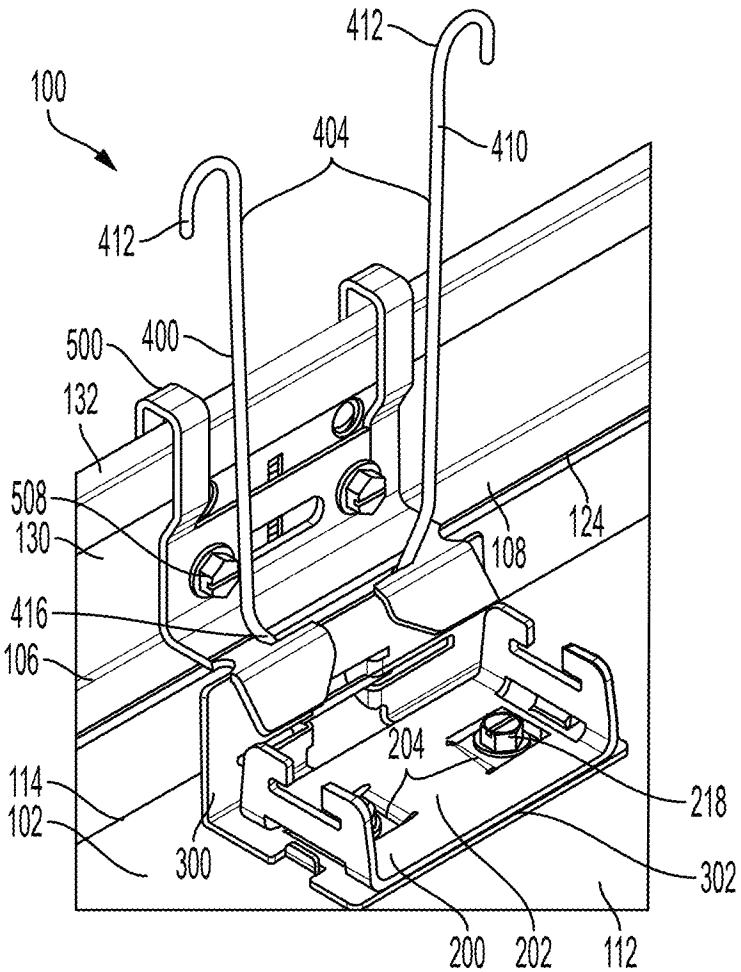
FIG. 4 is an isometric view of a portion of an edge of a ceiling panel coupled by a pair of cantilevers of the spring to the spring holster on the T-bar, with a bight of the spring held in the spring yoke, which is attached to the panel by a slider plate.
Figure 6:
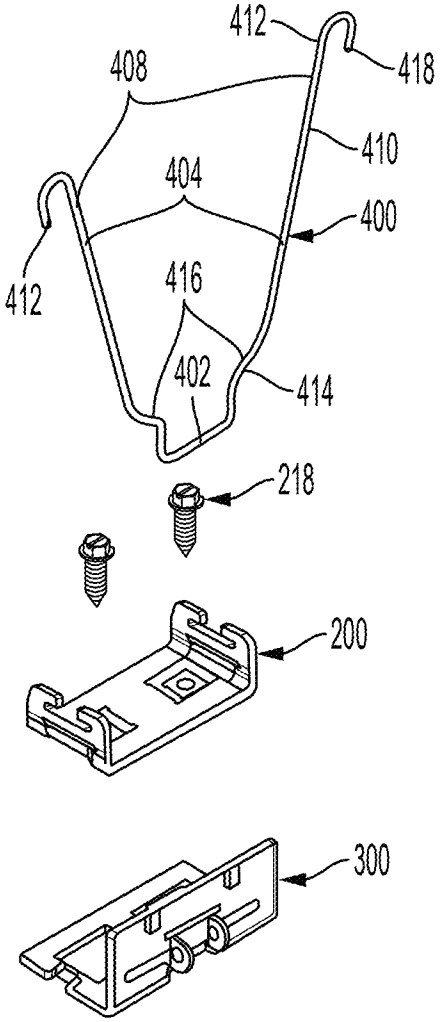
FIG. 6 is an exploded, isometric view of the spring, the spring yoke, and the slider plate as in FIG. 4, and showing a pair of screws that are configured for fastening the slider plate and spring yoke to the panel.

As depicted in the drawings, a system 100 incorporating an embodiment of the present disclosure may be used with ceiling panels or other panels 102 to hang the panels in an array or grid 104 of suspended T-bars 106 with flanges 108 (FIGS. 1, 4, and 13-19). Each ceiling panel 102 typically defines a lower or front surface 110 and an opposed upper or back surface 112 and a first edge 114 and a second edge 116 opposite and parallel to the first edge, and a third edge 118 and a fourth edge 120 opposite and parallel to the third edge, the third and fourth edges being perpendicular to the first and second edges. The four edges of the panels are typically configured to be aligned with the array of suspended T-bars along edges 124 of the T-bar flanges 108.

System 100 may be operational for connecting and positioning ceiling panels 102 in grid 104 of suspended T-bars 106. Components in the system for connecting and positioning the panels may include a plurality of plates, such as slider plates 200, and a plurality of spring yokes 300 coupled to the upper surface of the panels. System 100 may further include a plurality of springs 400 that may be held at one end in the spring yokes and selectively coupled to a plurality of spring holsters 500 that may be attached to the T-bars. Typically, system 100 will include an equal number of each of the slider plates, spring yokes, springs, and half as many spring holsters, interconnected as described below. System 100 may further include a plurality of alignment clips 600 (FIGS. 19-22) and a plurality of stiffener clips 700 (FIGS. 14 and 23-25). A plurality of stiffener bars 702 may be provided for coupling to either or both of the stiffener clips and the slider plates as will be further described below.

Figure 14:
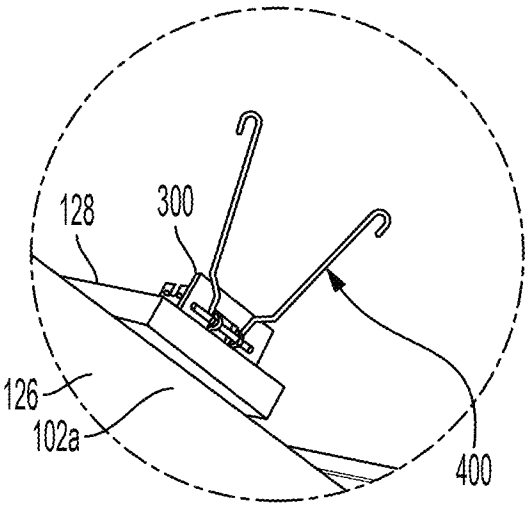
FIG. 14 is a close-up perspective view taken from FIG. 13, and showing one of the uncoupled springs.
Figure 13:
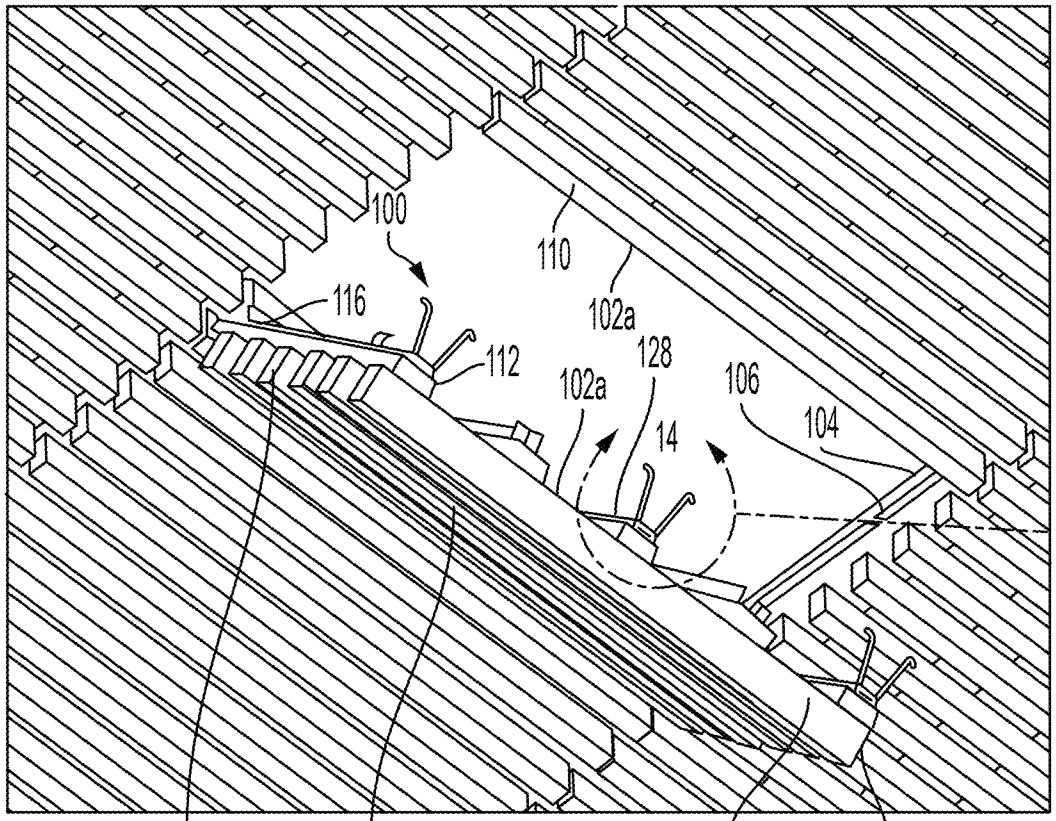
FIG. 13 is a perspective view from below of a T-bar grid with ceiling panels according to the present disclosure installed, including one panel with the springs coupled on a far edge of the panel and uncoupled on the near edge of the panel.

System 100 may be used in any type of ceiling panel, for example a panel 102*a* as shown in FIGS. 13-14, constructed of slats 126 that provide lower surface 110 of panel 102*a* and that are coupled together by beams, such as one or more backers 128 that provide upper surface 112. Another suitable embodiment is ceiling panel 102*b* (FIGS. 4 and 15-19) formed of a single solid panel portion 130 to provide lower surface 110 and upper surface 112.

Panels 102 or 102*a*, including any slats, backers, and/or panel portions may be formed of any suitable material, such as an engineered wood product. Panels may be expected to expand and contract, in the course of environmental changes in heat and moisture, along an x-axis and a y-axis defined by the main expanse of the panel and also to warp into a z-axis perpendicular to the x-y plane.

While panel expansion and contraction confined to the x-y plane is generally considered to be unavoidable and not particularly bad, at least in part because such movement in the x-y plane may be counteracted by the cooperation of the slider plates with the spring yokes, as will be further described below. However, warping into the z-axis is highly undesirable. So the stiffener bars may be employed, allowing the x-y movement but opposing z-axis warping, as will also be further described below.

Slider plates 200 may be constructed in any manner as best suited for the particular application of the attachment system. For example, for a typical office or residential building structure a pre-gal steel may be suitable. Slider plates 200 made of steel could be formed from a 16 gauge (i.e., about 0.064") with a suitable tolerance, such as ±0.002".

As best seen in FIGS. 4-9, each slider plate 200 may be formed by cutting or stamping and then bending a metal material to include a main surface 202 and one or more standoffs, such as standoff tabs 204. Each standoff 204 may be formed by cutting a U-shaped channel 206 in main surface 202 and introducing a bent portion 208, e.g., by making two adjacent bends in tab portion 204 at the ends of the arms of the U-shaped channel.

Bent portion 208 may, for example, include a first downward bend 210 at an angle, such as 50°, with a radius of, e.g., 0.02", and a second upward bend 212 at the same angle and radius as the downward bend. This is one manner suitable for providing tab portions 204 to be offset from main surface 202 by an offset distance 214. As one example, offset distance 214 may be about 0.046" with a tolerance of +0.01" and −0.005". In any case, offset distance 214 is typically configured for a desired cooperation with the thickness of spring yoke 300, as will be further described below.

Standoffs 204 provide for main surface 202 of slider plate 200 to be raised above upper surface 112 of ceiling panel 102. Bending tab portions is one manner in which slider plate 200 may be configured, when attached to ceiling panel 102, for standoff 204 to be in contact with upper surface 112 of ceiling panel 102 and for main surface 202 to be separated from upper surface 112 of ceiling panel 102.

Slider plates 200 may be attached to upper surface 112 of ceiling panel 102 by any means as best suited to the particular application of the panel. For example, each slider plate may include one or more holes 216 to receive a corresponding number of screws 218. Typically holes 216 are located in the tab portions to attach the standoffs to the panel while leaving the area beneath main surface 202 surrounding the standoffs generally free from any obstruction to allow free movement of spring yokes 300 in an x-y plane as will be further described below. Two or more screw holes 216 may be provided to fix slider plate 200 in place in three dimensions, or a single hole could be combined with another means, such as a lance, for preventing movement of slider plate 200 in an x-y plane, as will be described in detail for alignment clips 600 and stiffener clips 700 below.

Slider plates 200 may provide one or more channels 220 configured to receive a portion of one of stiffener bars 702. One manner in which a pair of channels for the stiffener bar may be formed is by cutting or stamping the channels at each of ends 222 of slider plate 200 while it is flat, and then bending up each of ends 222 to provide an aligned pair of channels 220 for the stiffener bar. For example, ends 222 may be bent to an angle of 90° with a radius of about 0.064".

Use of slider plates 200 in cooperation with stiffener bars 702 allows the stiffener bars to be assembled and to be effective closer to the edge of the panel, for an increased inhibition of warping or twisting or other movement of any portion of the panel into the z-axis perpendicular to the main surfaces of the panel. Ends 222 may be provided with rounded and/or angled edges 224 to reduce binding during the process of assembling and/or installing the ceiling panels.

Spring yokes 300 may be formed in any suitable manner fora particular type of ceiling panel and planned installation environment. For example, spring yokes 300 may be stamped or cut from a flat metal sheet, such as annealed spring steel which may be about 0.036" thick ±0.002" and heat treated, for example by austempering to a Rockwell C hardness in a range between about 48 and about 52. Yokes 300 may be provided with a suitable finish, such as a black-oxide coating.

Each spring yoke 300 may be coupled adjacent upper surface 112 of ceiling panel 102 by being captured beneath a corresponding slider plate 200. For example, each spring yoke 300 may have an L-shape that includes a lower horizontal portion 302 configured to fit beneath main surface 202 of a corresponding one of slider plates 200. Typically, horizontal portion 302 is thinner than offset distance 214. Horizontal portion 302 may include one or more windows 304 sized and shaped to receive corresponding standoff(s) 204 of slider plate 200. Typically windows 304 are larger in at least one of the x and y dimensions, parallel to the horizontal portion, than the x and y dimensions of standoffs 204. The standoffs and windows by this configuration cooperate to capture horizontal portion 302 beneath main surface 202 while allow spring yoke 300 to move in the plane parallel to upper surface 112 of ceiling panel 102.

Spring yoke 300 may include another portion 306 providing the means for coupling to one of springs 400. Portion 306 may extend upward from horizontal portion 302, such as perpendicularly to horizontal portion 302. Spring yoke 300 may include a bracket 308, typically located in portion 306, providing for each spring 400 to have a storage position and an installation-ready position in a manner that will be further described below. Bracket 308 may be provided with a first portion 310 for positioning spring 400 in the installation-ready position and a second portion 312 for positioning spring 400 in the storage position.

Springs 400 may be formed in any manner that is suited to the particular application of the attachment system and ceiling panel. For example, spring 400 may be formed from a suitable wire, such as phosphate coated music wire that may be heat treated. An example of a suitable heat treatment is a stress-relieving treatment where the temperature is held constant at about 540° F. for about 60 minutes. The stress-relieving treatment may be provided after the wire is formed into the shape that will be described below. A suitable gauge for the wire is a diameter of about 0.085"±0.001".

Each spring 400 may be configured to couple to the bracket of the spring yoke and to the spring holster, thereby coupling the spring yoke and the panel to the spring holster and the grid of T-bars. Each spring may be formed into a substantially U-shaped configuration with a bight 402 between two arms 404. The portion of spring 400 adjacent bight 402 and a proximal portion of arms 404 may define a first end 406 of spring 400 and a distal portion 408 of arms 404 may define a second end 410 of spring 400, including a hook 412 at the end of each arm 404.

Each spring 400 may define a first positioning mechanism 414, which may include a pair of cantilevers 416 adjacent first end 406 of spring 400. Each spring 400 may define a second positioning mechanism 418 including a pair of hooks 412, one at the end of each arm 404. The positioning mechanisms may cooperate with spring holsters 500 to provide options for the position of the panel in a manner to be further described below.

Spring holsters 500 may be formed in any suitable manner for a particular installation environment and suspension grid. Spring holsters 500 are typically formed with a structure that fits over a vertical portion 130 of the T-bar 106 and extends down on each side of the vertical portion to the T-bar flange 108. Each spring holster 500 typically is configured for coupling to two spring yokes, one on each side of the T-bar, so each spring holster may be coupled to two adjacent panels 102. The following description focuses on the coupling of the spring holster to the panel on just one side of the T-bar and the portion of the spring holster on the other side of the T-bar typically provides the same coupling structure.

Spring holsters 500 may be formed, for example, from a pre-gal steel or other flat metal. A suitable thickness includes 18 gauge (i.e., about 0.052") with an appropriate tolerance, such as ±0.002".

Spring holsters 500 may be configured to be attached to the suspended bars, for example by being provided with a substantially saddle-shaped configuration including a loop portion 502 configured to receive a thicker portion 132 of vertical portion 130 of T-bar 106, and a pair of sides 504 extending down from loop portion 502. Sides 504 may be configured to abut vertical portion 130 and may include one or more threaded holes 506 to receive screws 508 to clamp spring holster 500 to T-bar 106.

Each spring holster 500 may include a skirt portion 510 on each side configured to extend over and beyond flange 108 of T-bar 106. Each spring holster 500 may include a pair of slots 512, one on each side, each configured to receive a spring 400 for coupling ceiling panel 102 to grid 104 of suspended bars 106.

Slot 512 of spring holster 500 may include a side entryway 518, which may include a wider distal portion 520. Side entryway 518 may narrow from distal portion 520 towards a proximal portion 522. To insert spring 400 into slot 512, an installer may compress spring 400, moving arms 404 closer together sufficiently to fit into slot 512. Side entryway 518 may provide a chamfer for more convenient insertion of spring 300 into slot 512 by allowing the installer to compress the arms to fit into the wider distal portion of the entryway with the further necessary compression provided by sliding the arms along the chamfer and into slot 512.

Figure 17:
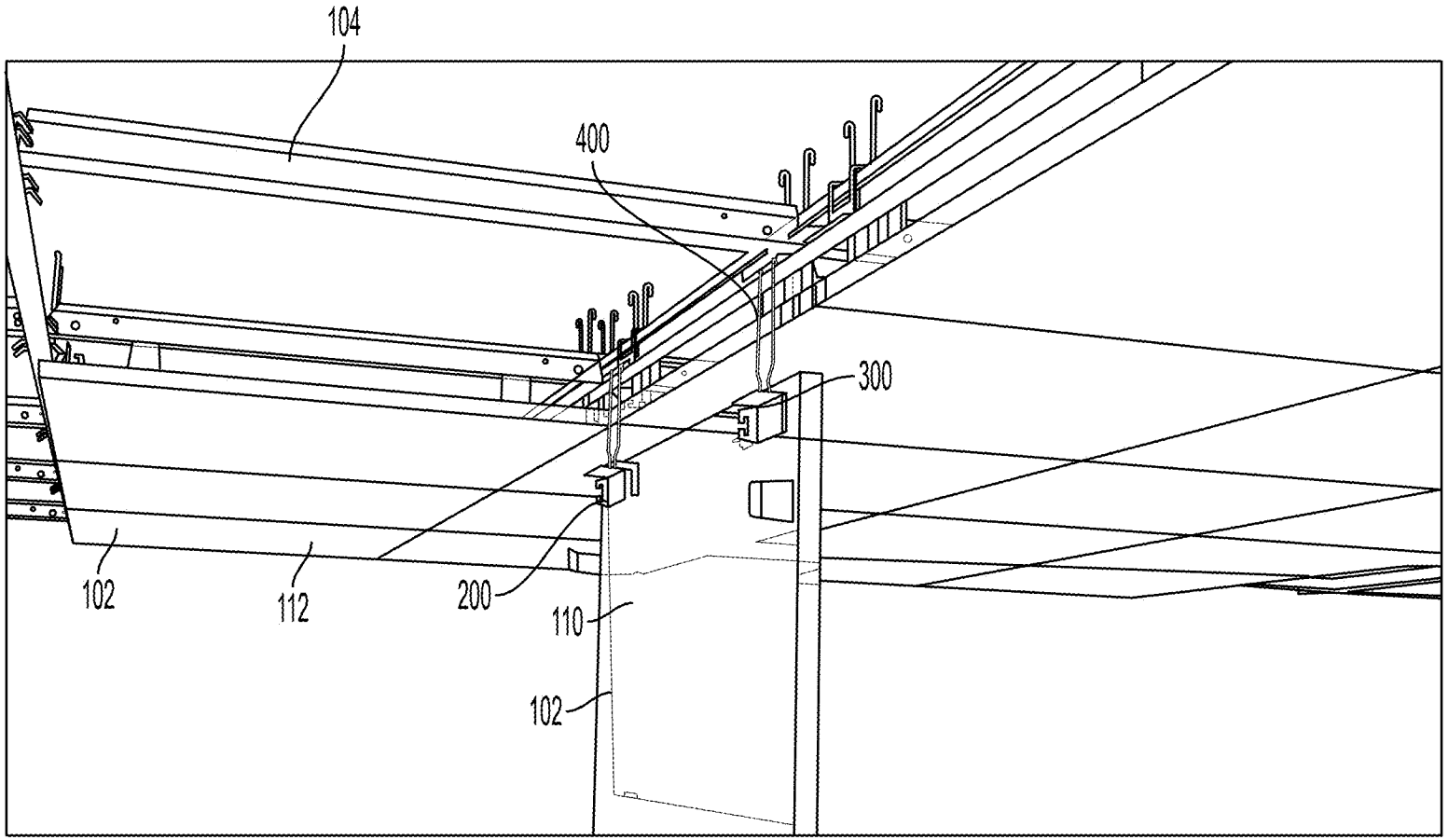
FIG. 17 is a perspective view of a T-bar grid and panels, similar to that of FIGS. 13 and 15, in this case illustrating another embodiment of a ceiling panel according to the present disclosure, the panel hanging perpendicularly from the grid to allow access to the space above the grid.

Slot 512 may be configured to receive the first and second positioning mechanisms 414, 418 of spring 400 for coupling the ceiling panel to the grid of suspended bars. For example, first positioning mechanism 414 may operate with slot 512 to allow for ceiling panel 102 to be coupled to grid 104 of suspended bars 106 in an installed position (FIGS. 4 and 19), and second positioning mechanism 418 may also operate with slot 512 to allow for ceiling panel 102 to be coupled to grid 104 of suspended bars 106 in an accessible position (FIG. 17).

Figure 16:
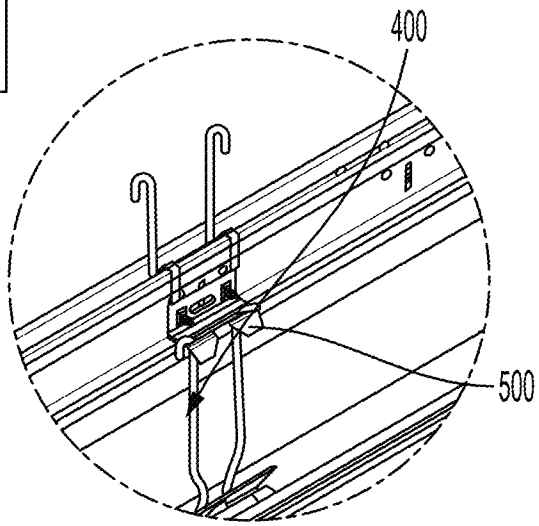
FIG. 16 is a close-up isometric view taken from FIG. 15, and showing one of the springs coupled between the spring yoke on the panel and the spring holster on the T-bar.

The two panels 102 shown in FIG. 16 depict the installed position (uppermost panel) and the accessible position (lowermost panel). As described above, first positioning mechanism 414 may be provided by a pair of cantilevers 416 adjacent the first end of the spring and second positioning mechanism 418 may be provided by a pair of hooks 420 adjacent the ends of arms 404. In this manner, both first positioning mechanism 414 and second positioning mechanism 418 of spring 400 may be configured to be received selectively in slot 512 of spring holster 500.

Skirt portion 510 of spring holster 500 may be provided with a pair of notches 514 configured to receive the ends of hooks 420 in the accessible position. Second positioning mechanism 418, such as hooks 420 being captured by outer edges 516 of slot 512 and notches 514 may additionally prevent disengagement of panel 102 in the case of panel 102 being dislodged from the installed position during a seismic event.

Figure 5:
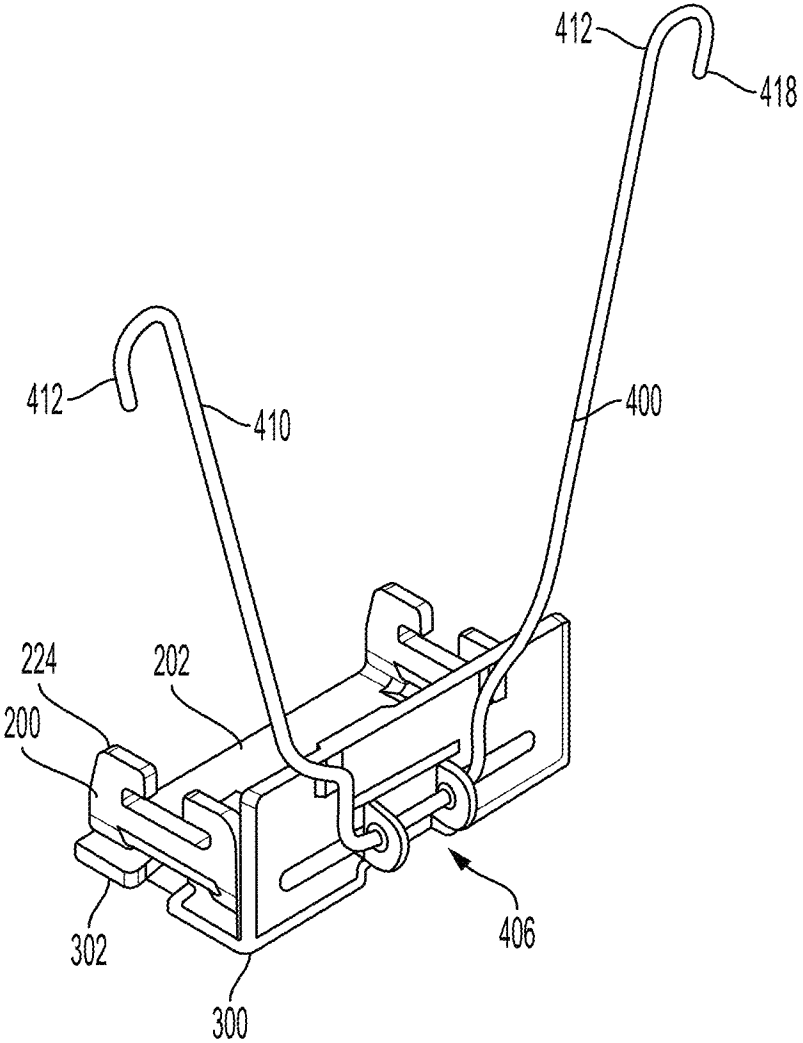
FIG. 5 is an isometric view of the spring, the spring yoke, and the slider plate, from the reverse angle as compared to FIG. 4 and shown without the panel for clarity.
Figure 10:
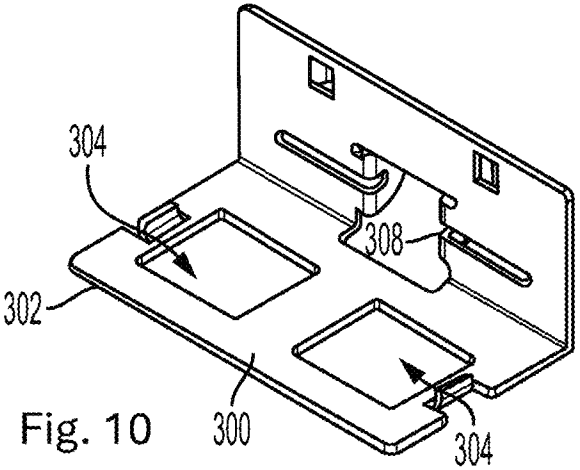
FIG. 10 is an isometric view of the spring yoke, showing the pair of windows in the lower portion of the spring yoke that are configured to receive the standoffs of the slider plate and an upper portion with a channel for receiving the spring.
Figure 11:
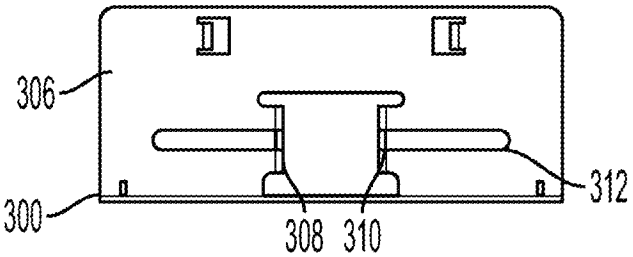
FIG. 11 is a side view of a long edge of the spring yoke.
Figure 12:
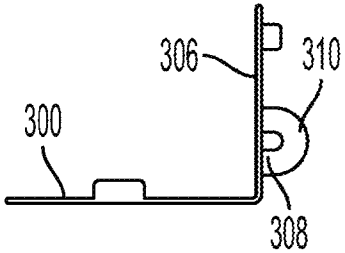
FIG. 12 is a side view of a short edge of the spring yoke.
Figure 7:
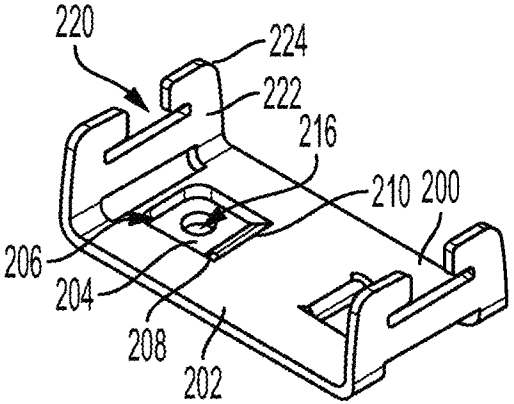
FIG. 7 is an isometric view of the slider plate, including guide channels to receive a stiffener bar and a pair of standoffs to raise the slider plate above the panel surface to receive a lower portion of the spring yoke within the pair of windows of the spring yoke, the standoffs also including mounting holes for to receive the screws of FIG. 6 to attach the slider plate to the panel.
Figure 8:
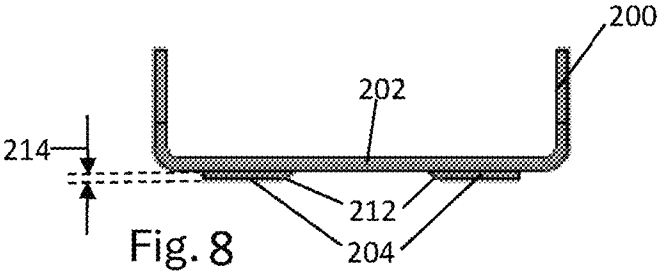
FIG. 8 is a side view of a long edge of the slider plate, showing the height of the standoffs providing a space for the lower portion of the spring yoke.
Figure 9:
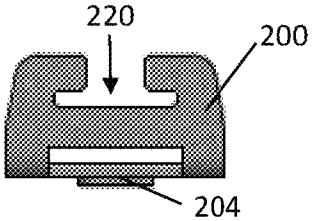
FIG. 9 is a side view of a short edge of the slider plate, also showing the height of one of the standoffs and the space for the lower portion of the spring yoke and the channel for receiving the stiffener bar.

As depicted, e.g., in FIG. 5, first portion 310 of bracket 308 of spring yoke 300 is configured to receive first end 406 of spring 400 to couple to spring yoke 300 in the installation-ready position. As shown in FIG. 17, second portion 312 of bracket 308 of spring yoke 300 is configured to receive second end 410 of spring 400 to couple to spring yoke 300 in the storage position. Springs 400, in the storage position, are fixed in position by the tension of spring 400 and generally do not extend away from panel 102, which may be convenient for packaging and/or stacking panels 102 for storage, transport, and/or maneuvering panels 102 in preparation for installation. When a panel is ready to be installed, spring 400 may be moved by the installer to the installation-ready position by pushing the spring with sufficient force to overcome the spring tension.

As seen in FIGS. 19-22, alignment clips 600 may be formed in any suitable manner for a particular ceiling panel, installation environment, and suspension grid. For example, alignment brackets 600 may be cut or stamped from flat metal and formed into a suitable shape. The metal may be a pre-gal steel with a suitable thickness such as 18 gauge (i.e., about 0.052") with an appropriate tolerance, such as ±0.002".

Figure 15:
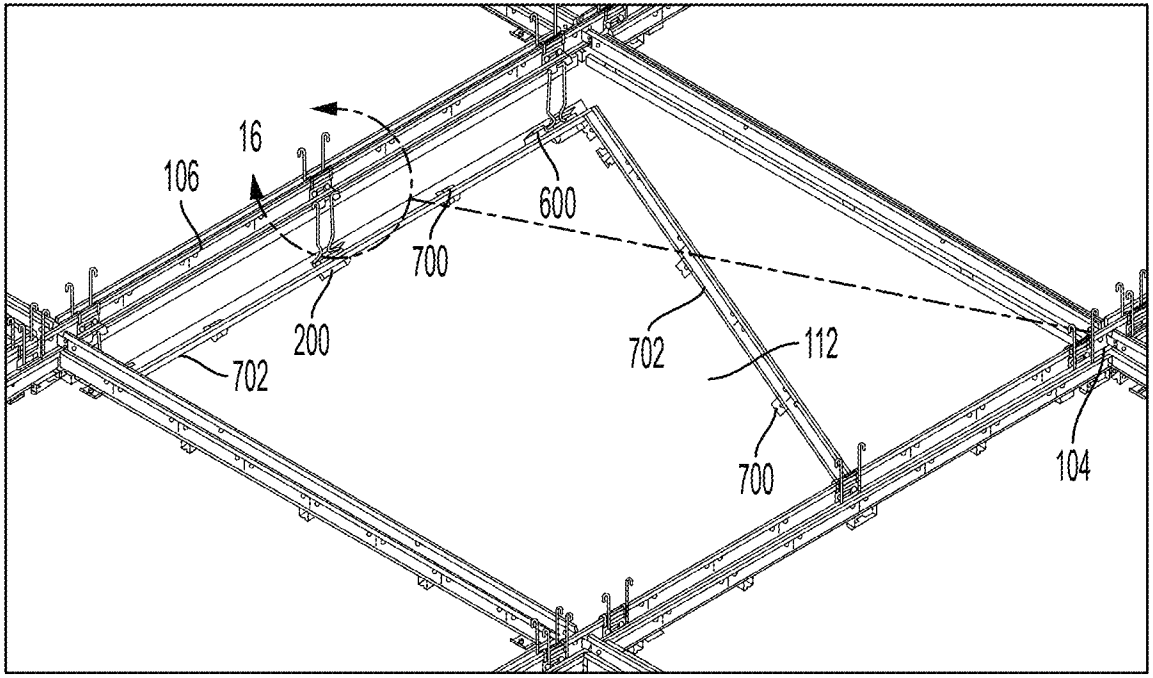
FIG. 15 is an isometric view from above of a T-bar grid with ceiling panels according to the present disclosure installed, including one panel with the springs coupled on the visible edge of the panel and uncoupled on the edge of the panel that is obscured from view by the adjacent installed panel, and also showing stiffener bars inserted through the channels of both stiffener clips and slider plates.
Figure 18:
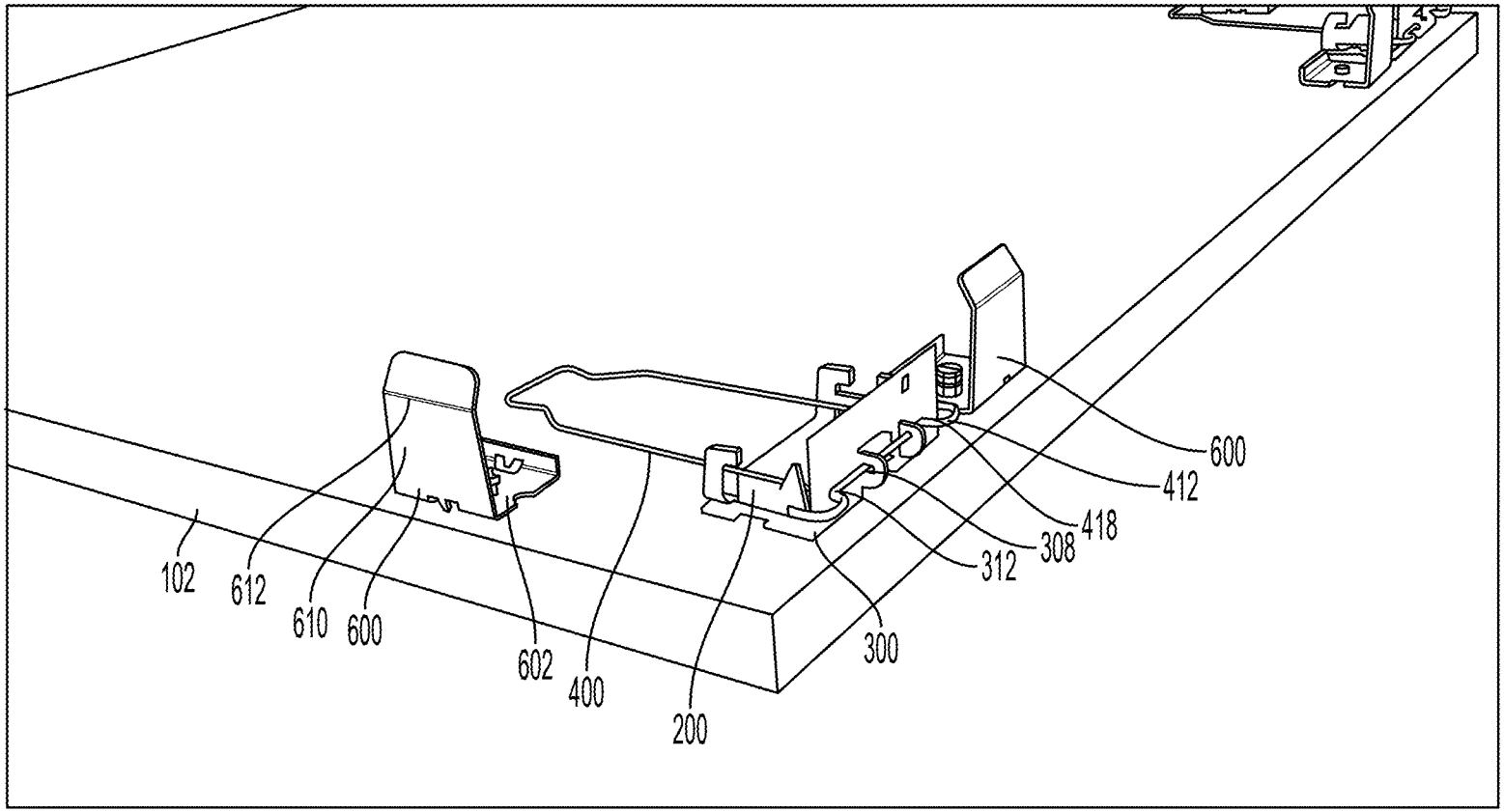
FIG. 18 is a perspective view of the ceiling panel, showing the spring in a storage/transport position in the spring yoke, and also showing an alignment clip coupled to the panel.
Figure 21:
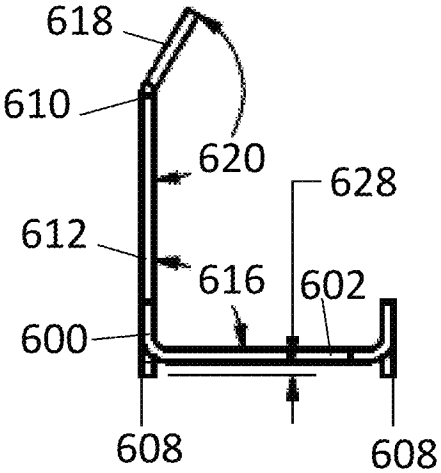
FIG. 21 is a side view of the alignment clip of FIGS. 19 and 20, showing the lower, horizontal portion and the upper portion, and lances extending below the lower portion.
Figure 22:
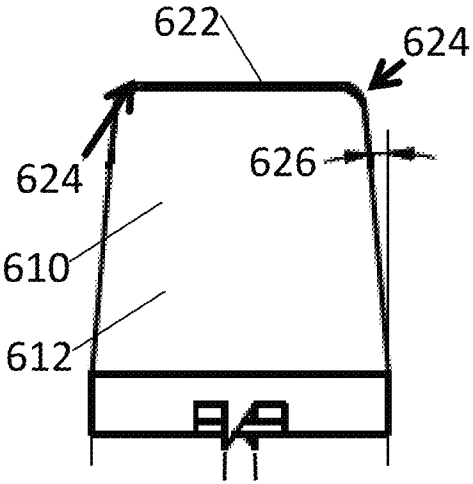
FIG. 22 is another side view of the alignment clip, rotated 90° from FIG. 21, showing the upper portion, the keyed alignment notches, and an upper edge with rounded corners.
Figure 19:
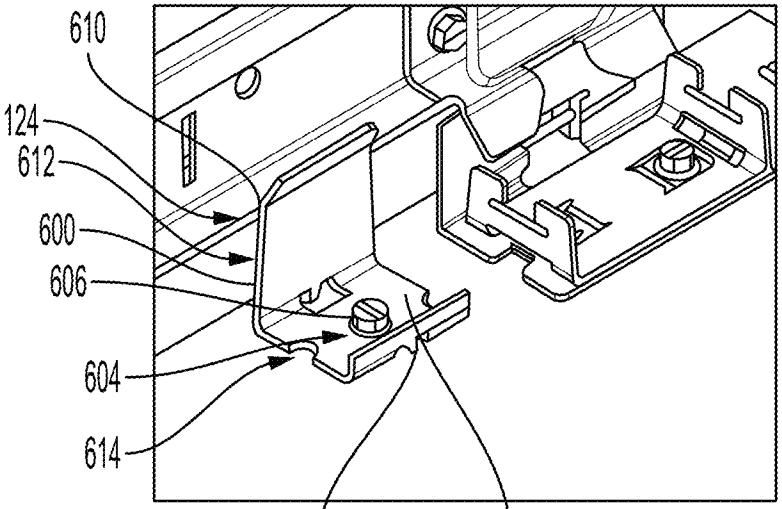
FIG. 19 is an isometric view of a portion of the ceiling panel adjacent a T-bar grid piece with an alignment clip abutting the T-bar grid piece, a spring yoke coupled to the panel by a slider plate, and the spring coupled to the panel by the spring yoke and to the T-bar grid by the spring holster.
Figure 20:
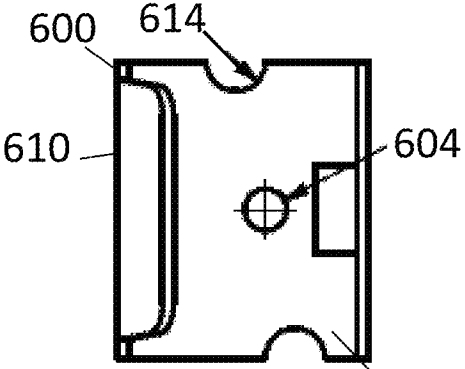
FIG. 20 is an overhead view of the alignment clip of FIG. 19, showing the lower, horizontal portion and an upper portion, a screw hole, and keyed alignment notches.

Each alignment clip 600 may be configured for attachment to upper surface 112 of ceiling panel 102, for example as in FIGS. 15 and 18. An example configuration is to provide the alignment clip with an L-shape that includes a lower horizontal portion 602 that may provide a hole 604 to receive a screw 606 to attach alignment clip 600 to upper surface 112 of panel 102. Horizontal portion 602 may include multiple hole-screw combinations to fix the alignment clip against rotation in the x-y plane, but preferably includes one or more lance(s) 608 extending downwardly from horizontal portion 602. Lance(s) 608 may be configured to pierce into upper surface 112, as screw 606 tightens the clip against the panel, thus allowing single screw attachment of the alignment clip while inhibiting rotation of the clip in the x-y plane during and after assembly.

Each alignment clip 600 may include an upper portion 610 which may extend upward from horizontal portion 602 at an angle 616, such as perpendicularly to horizontal portion 602. Upper portion 610 may include a flat surface 612 configured to rest against a flange 108 of one of suspended bars 106. Alignment clip 600 may include one or more notches, for example a pair of keyed notches 614 in horizontal portion 602, which may cooperate with an assembly fixture (not shown) to provide a desired precision of positioning to alignment clip 600 so as to act as a reference for the position of panel 102 relative to grid 104 of T-bars 106. The abutting of flange 108 of the T-bar 106 by flat surface 612 tends to align ceiling panel 102 with grid 104. Panel 102 may compensate for manufacturing tolerances and environmental variations in the size of panel 102 to provide such alignment by allowing movement of spring yoke 300 under slider plate 200 relative to panel 102 as described above.

Upper portion 610 of alignment clip 600 may extend to a portion 618, that is at an angle 620, such as about 150°, relative to upper portion 610. Angled portion 618 may extend up to an upper edge 622 with rounded corners 624. Angled portion 618 and rounded corners 624 may be useful in reducing binding during the assembly process. Upper portion 610 may taper inwardly at an angle 626, for example about 5°. Lances 608 may extend below lower portion 602 by a distance 628 of about 0.063".

A suitable number and positioning of alignment clips 600 may be provided for a desired alignment of panels 102 in grid 104. For example, one or more alignment clips brackets may be attached along one, two, three, or four of the edges of panel 102. Typically, the ceiling panel includes one or two alignment clips 600 attached adjacent first edge 114 and one or two alignment 602 attached adjacent second edge 116 opposite the first edge. FIG. 18 illustrates that one or more alignment clips may additionally be placed on the third and fourth edges of panel 102.

Stiffener clips 700 may be formed in any suitable manner for a particular ceiling panel, installation environment, and suspension grid. For example, stiffener clips 700 may be cut or stamped from flat metal and formed into a suitable shape. The metal may be a pre-gal steel with a suitable thickness such as 18 gauge (i.e., about 0.052") with an appropriate tolerance, such as ±0.002".

Each stiffener clip 700 may be configured for attachment to upper surface 112 of ceiling panel 102. For example, as best seen in FIGS. 23-25, each clip may include a central horizontal portion 704 that may provide a hole 706 to receive a screw 708 to attach stiffener clip 700 to upper surface 112 of panel 102 (FIG. 15). Horizontal portion 704 may include multiple hole-screw combinations to fix the clip against rotation in the x-y plane, but preferably includes one or more lance(s) 710 extending downwardly from horizontal portion 704 by a distance 722, which may be about 0.063". Lance(s) 710 may be configured to pierce into upper surface 112, as screw 708 tightens the clip against the panel, thus allowing single screw attachment of the clip while inhibiting rotation of the clip in the x-y plane during and after assembly. Lance(s) 710, as well as the other lances described herein, may have a width 724 at their base, for example of about 0.125".

Stiffener clips 700 may provide one or more channels 712 configured to receive a portion of one of stiffener bars 702. Channels 712 may have a width 728, which may be about 0.625", and a height 730, which may be about 0.084" with a tolerance of +0.01"/−0.005". One manner in which a pair of channels for the stiffener bar may be formed is by cutting or stamping the channels at each of ends 714 of stiffener clip 700 while it is flat, and then bending up each of ends 714 to provide an aligned pair of channels 716 for the stiffener bar. Preferably, ends 714 are bent to an angle of 90° relative to horizontal portion 704. Ends 714 may be provided with rounded and/or angled edges 718 to reduce binding during the process of assembling and/or installing the ceiling panels. For example, edges 718 may taper inwardly at an angle 726, which may be about 10°.

Each stiffener clip 700 may include one or more notches, for example a pair of keyed notches 720 in horizontal portion 704, which may cooperate with an assembly fixture (not shown) to position each stiffener clip 700 to align with an edge of panel 102 and with any slider plates with stiffener channels along such edge.

As noted above and depicted in FIG. 15, stiffener clips 700 may be used, along with stiffener channels 220 in slider plates 200, in cooperation with stiffener bars 702. Insertion of stiffener bars through the channels of stiffener clips 700 and slider plates 200 inhibits warping, twisting, and other movement of any portion of the panel into the z-axis perpendicular to the main surfaces of the panel.

A suitable stiffener bar 702 may be formed from standard commercially available 9/16" T-bar cut into lengths as appropriate for the size of the ceiling panel. Inserting stiffener bar 702 through the channels in the slider plates and/or the stiffener clips allows for wood expansion and contraction of the panel in the x-y plane while substantially inhibiting warping or twisting or other movement relative to the z-axis perpendicular to the main surfaces of the panel.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Specific details are given in the above description to provide a thorough understanding of the embodiments. However, it is understood that the embodiments may be practiced without these specific details. For example, structures be shown in simplified diagrams in order not to obscure the embodiments in any detail. In other instances, well-known processes, structures, and techniques may be shown without unnecessary detail in order to avoid obscuring the embodiments.

The corresponding structures, materials, acts, and equivalents of all means or step plus function elements in the claims are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A system for connecting ceiling panels to a grid of suspended bars, comprising:

a plurality of said ceiling panels, each ceiling panel defining a lower surface opposite an upper surface, each ceiling panel comprising:

a. a plurality of plates attached to the upper surface of the ceiling panel, each plate defining a main surface and a standoff that is offset from the main surface by an offset distance wherein the standoff contacts the upper surface of the ceiling panel and the main surface is separated from the upper surface of the ceiling panel;

b. a plurality of spring yokes coupled adjacent the upper surface of the ceiling panel, each spring yoke including a horizontal portion located beneath the main surface of a corresponding one of the plates and coupled to the ceiling panel, the horizontal portion further including a window that receives the standoff of the plate configured to allow the spring yoke to move in a plane parallel to the upper surface of the ceiling panel; and c. a plurality of springs, each spring coupling a corresponding one of the spring yokes to the grid of suspended bars.

2. The system of claim 1 wherein each plate includes a second standoff that is offset from the main surface by the offset distance, and wherein each spring yoke includes a second window configured to receive the second standoff of the spring yoke.

3. The system of claim 1 wherein at least a portion of the plates includes a channel for receiving a stiffener bar.

4. The system of claim 1 further comprising a stiffener clip attached to the upper surface of the ceiling panel, the stiffener clip including a channel for receiving a stiffener bar.

5. The system of claim 4 wherein the stiffener clip is provided with at least one notch configured to be used to align the stiffener clip relative to the ceiling panel.

6. The system of claim 1 further including a plurality of spring holsters configured to be attached to the suspended bars, each spring holster including a slot for receiving the spring for coupling the ceiling panel to the grid of suspended bars.

7. The system of claim 6 wherein at least a portion of the springs are provided with a first positioning mechanism allowing for the ceiling panel to be coupled to the grid of suspended bars in an installed position and a second positioning mechanism allowing for the ceiling panel to be coupled to the grid of suspended bars in an accessible position.

8. The system of claim 7 wherein both the first positioning mechanism and the second positioning mechanism of the spring are configured to be received selectively in the slot of the spring holster.

9. The system of claim 7 wherein each spring defines a first end coupled to a corresponding one of the spring yokes, and wherein the first positioning mechanism is a pair of cantilevers adjacent the first end of the spring.

10. The system of claim 9 wherein each spring defines a second end opposite the first end, and wherein the second positioning mechanism is a pair of hooks adjacent the second end of the spring.

11. The system of claim 1 further comprising an alignment clip attached to the upper surface of the ceiling panel, the alignment clip including a flat surface configured to rest against one of the suspended bars to align the ceiling panel with the grid.

12. The system of claim 11 further comprising a second alignment clip attached to the upper surface of the ceiling panel, the second alignment clip including a flat surface configured to rest against one of the suspended bars to align the ceiling panel with the grid.

13. The system of claim 12 wherein the ceiling panel further defines a first edge and an opposite second edge, and wherein one alignment clip is attached adjacent the first edge and the other alignment clip is attached adjacent the second edge.

14. The system of claim 11 wherein the alignment clip is provided with at least one notch configured to be used to align the alignment clip relative to the ceiling panel.

15. The system of claim 14 wherein the alignment clip is provided with at least one lance configured to pierce the upper surface of the ceiling panel during attachment, the lance further configured to fix the alignment clip against rotation in a plane parallel to the upper surface of the ceiling panel.

16. The system of claim 15 wherein the stiffener clip is provided with at least one lance configured to pierce the upper surface of the ceiling panel during attachment and to fix the stiffener clip against rotation in a plane parallel to the upper surface of the ceiling panel.

* * * * *